US005422218A

United States Patent [19]

Tong

[11] Patent Number: 5,422,218

[45] Date of Patent: Jun. 6, 1995

[54] ELECTROPHOTOGRAPHIC TONER COMPOSITIONS

[75] Inventor: Hun-Yi Tong, Miao Li Hsien, Taiwan, Prov. of China

[73] Assignee: Industrial Technology Research Institute, Hsinchu, Taiwan, Prov. of China

[21] Appl. No.: 37,026

[22] Filed: Mar. 25, 1993

[51] Int. Cl.[6] ..... G03G 9/00

[52] U.S. Cl. ..... 430/110; 430/109

[58] Field of Search ..... 430/110, 109

[56] References Cited

U.S. PATENT DOCUMENTS

| | | | |
|---|---|---|---|
| 4,340,660 | 7/1982 | Kiuchi | 430/106.6 |
| 4,486,524 | 12/1984 | Fujisaki | 430/109 |
| 4,557,991 | 12/1985 | Takagiwa | 430/109 |
| 4,579,908 | 4/1986 | Fujii | 525/106 |
| 4,626,488 | 12/1986 | Inoue | 430/109 |
| 4,652,511 | 3/1987 | Ueda | 430/137 |
| 4,939,060 | 7/1990 | Tomiyama et al. | 430/109 |
| 4,966,829 | 10/1990 | Yasuda | 430/109 |
| 4,967,236 | 10/1990 | Rodenberg | 355/272 |
| 5,135,833 | 8/1992 | Matsunaga et al. | 430/110 |
| 5,236,799 | 8/1993 | Chen et al. | 430/109 |

*Primary Examiner*—Mark A. Chapman
*Attorney, Agent, or Firm*—W. Wayne Liauh

[57] ABSTRACT

A toner composition for use in electrophotographic processes containing a resin binder which about 10 to 40% of THF-insoluble gel portion and about 60 to 90% of THF-soluble portion. The THF-soluble portion has a trimodal molecular weight distribution having three main peaks as shown in chromatograms from gel permeation chromatography, the first main peak has a molecular weight between 3,000 and 30,000, the second main peak has a molecular weight between 30,000 and 200,000, and the third main peak has a molecular weight between 200,000 and 2,750,000. The ratio among the first, second, and third main peaks is about 0.4–1.0/1/0-.4–1.5, measured based on their respective peak heights. The resin binder further contains about 0.5 to 1.5% polysiloxane uniformly dispersed therein. The polysiloxane is added to the resin binder along with polymerization monomers during the polymerization reaction to produce the resin binder.

11 Claims, 2 Drawing Sheets

ELECTROPHOTOGRAPHIC TONER COMPOSITIONS

FIELD OF THE INVENTION

This invention relates to an electrophotographic toner composition. More particularly, this invention relates to an electrostatic image developer, or the so-called toner, composition that contains a polymeric resin binder for use in electrophotographic imaging processes in, for example, copy machines, laser printers, or laser facsimile machines.

BACKGROUND OF THE INVENTION

In an electrophotographic process, electrostatic latent images are first formed on a photosensitive member of a photoconductor by various exposure means. The electrostatic latent images are then developed using an electrostatic image developer, or the so-called toner, and are subsequently transferred onto a transfer material such as paper or transparent films to produce positive images. Typically a pressure heating system utilizing hot rollers is applied to fix the toner image on the transfer material and produce permanent prints. Finally, the toner remaining on the photosensitive member is removed to prepare the photosensitive member for next electrophotographic operation.

Toner and photoconductor are the two most important expense items in copiers and/or laser printers. The toners that are commonly used in the electrophotographic process comprise a resin binder, a pigment such as carbon black or $Fe_3O_4$, a charge control agent (CCA), a low molecular weight polymeric wax type release agent such as low molecular weight polyethylene or low molecular weight polypropylene. The amount of resin binder typically constitutes about 50–90% of the total toner composition. In addition to its function as a binder to bind together all the components of a toner composition, a resin binder also imparts many of the important printing qualities that can significantly affect the toner performance in the electrophotographic process. The qualities, which include thermal fixing property, anti-offseting characteristics, humidity resistance, optical (toner) density, uniformity, storageability, etc, are the focus of extensive research efforts in attempts to improve the electrophotographic process. With the proliferation of high performance personal computers which has brought forth a strong demand for laser printers, and the increased availability of high speed copying machines, both of which result in significant increase in toner consumption, the need to develop improved toners further escalates.

U.S. Pat. No. 4,340,660 ('660 patent) discloses a toner composition comprising a first crosslinked vinyl polymer having a gel content of 50–99% and a second crosslinked vinyl polymer having a gel content of 0–10%. The first vinyl polymer was prepared from an emulsion polymerization technique and the second vinyl polymer was prepared from a solution polymerization technique. The two polymers were mixed in a ball-mill followed by melting and kneading by a roll mill to become a resin binder for use in a toner composition. The polymer blend disclosed in the '660 patent provides good thermal fixing property and anti-offseting characteristics; however, it suffers from a quality control problem due to the complexity of the blending process.

U.S. Pat. No. 4,486,524 ('524 patent) discloses a toner comprising a resin component which does not require a blend as does the '660 patent. In the '524 patent, the resin was prepared using a bulk polymerization technique at low temperature low initiator concentration condition, followed by a solution polymerization with the addition of fresh reaction monomers containing a higher concentration of initiator. The resin prepared from the '524 patent is a mixture of two polymers, one has a molecular weight between 2,000 and 30,000 and the other between 100,000 and 500,000.

U.S. Pat. No. 4,652,511 ('511 patent) discloses a process for producing a resin composition by first preparing a high-molecular-weight polymer having a weight average molecular weight of at least 500,000 using an emulsion polymerization technique. The reaction product, being in a latex form and containing high-molecular-weight polymer, was then subject to a suspension polymerization reaction to obtain a polymer mixture containing the high-molecular-weight polymer and a low-molecular-weight polymer. The low-molecular-weight polymer has a weight average molecular weight of between 5,000 and 50,000.

U.S. Pat. No. 4,966,829 ('829 patent) discloses a toner composition containing a resin binder which has a bimodal molecular weight distribution, with a main peak in the molecular weight range of 1,000 to 25,000 and a shoulder in the molecular weight range of 2,000 to 150,000. In the '829 patent, the resin binder was prepared in a two-step process by first producing a low-molecular-weight polystyrene using a solution polymerization technique. The low-molecular-weight polystyrene was then dissolved in a suspending monomer solution to effect a suspension polymerization reaction.

All the resin binders disclosed in '524, '511 and '829 patents mentioned above avoid the blending step required in the '660 patent; however, they involve a multistep process that is necessarily cumbersome and time-consuming. Furthermore, because all of these process involve two or more different polymerization mechanisms, the amount of liquid wastes generated therefrom can be quite significant. And the disposal of spent solvent could also present an environmental problem.

Anti-offseting characteristic is also an important consideration for electrophotographic toners. One approach to improve the offsetting problem is to apply a silicone oil over the surface of the fixing roller, in a process disclosed in U.S. Pat. No. 4,579,908. The extra step of applying the silicone oil complicates the design of a copy machine or a laser printer. The need to use silicone oil in the copying or printing machine also introduces the problems of environment pollution. Therefore, it is preferable to develop toners with improved anti-offsetting property that do not require the need of applying silicone oil.

Japanese Pat. Pub. No. 62-96672 ('672 reference) discloses a toner composition containing particulate flow aids whose surface is coated with silicone oil. In the preparation of the toner powder, it typically goes through the steps of blending, milling, coarse-pulverizing and find-pulverizing to obtain toner powder having a particle size between 5–30 μm. To obtain favorable rheological properties and electrostatic chargeability thereof, about 0.1 to 2 wt % of flow aids are often added to the toner powder. Commonly used flow aids include silicon dioxide ($SiO_2$), titanium dioxide ($TiO_2$), aluminum oxide ($Al_2O_3$), etc., which are uniformly dispersed onto the surface of the toner powder after thorough blending. After long-term storage or exposure to high-humidity environment, the flow aids often absorb moisture which would adversely affect the rheological property and electrostatic chargeability of the toner powder to which they are attached.

The '672 reference was intended to improve the inadequate hydrophobic characteristic of the flow aids described above by applying thereon a layer of silicone oil. However, in actual situations, other components of the toner, such as resin binder, pigment, charge control agent, etc, could also absorb moisture, in addition to the flow aids. And the surface area covered by the hydrophobically treated flow aids only comprises a relatively smaller portion of the total surface area of the toner powder. Therefore, even after the hydrophobic treatment of the flow aids, the problem regarding the humidity resistance of the toner still remains largely unsolved. Furthermore, the hydrophobic treatment disclosed in the '672 reference created a new problem in that the primary particles of the flow aids often become primary aggregates or bulk aggregates after the silicone oil treatment regardless of whether spraying or soaking method is used to effect the coating layer. This prevents a desired uniform blending between the toner powder and the flow aids. Consequently, there also remains a need to develop improved toners at least with regard to the long-term storageability and tolerance under a high humidity environment.

Toner compositions are also taught in a number of other U.S. Patents, such as U.S. Pat. Nos. 5,162,188, 5,166,026, 5,166,029, 5,169,736, 5,171,653, 5,173,387, 5,175,070, and 5,175,071.

SUMMARY OF THE PRESENT INVENTION

The primary object of the present invention is to develop a toner composition for use in electrophotographic imaging processes that eliminates the aforementioned problems existing in the prior art toners while retaining and/or enhancing the advantages thereof.

More particularly, the primary object of the present invention is to develop a toner composition that provides excellent qualities, such as thermal fixing property, anti-offseting characteristics, appropriate printing concentration, and uniformity, when used in electrophotographic imaging processes. The toner composition developed in the present invention also provides excellent humidity resistance and long-term storageability, without incurring the pollution problems associated with the use of silicone oil release agent on the pressure heating rolls as disclosed in the prior art. Furthermore, the toner disclosed in the present invention allows the copy machine using the same to maintain excellent print quality even after large numbers of repeated applications.

The toner composition disclosed in the present invention contains a resin binder produced from a noval reaction recipe using a noval reaction procedure, both of which were fruit of extensive experimental efforts by the inventors. The resin binder of the present invention is a styrene-acrylic type copolymer with an appropriate crosslinking density and a abroad molecular weight distribution. The crosslinking density of the resin is indicated by its THF (tetrahydrofuran)-insoluble gel content. It is preferred that the THF-insoluble portion constitutes about 10 to 40% of the resin composition. If the THF-insoluble portion is less than 10 wt %, the toner prepared therefrom does not provide the required anti-offsetting characteristics. Above 40%, the toners would show poor thermal fixing property.

The THF-soluble content, which preferably constitutes about 60 to 90% of the resin, has a trimodal molecular weight distribution, as measured with gel permeation chromatography (GPC). The first peak (peak A) occurs at a molecular weight of between about 3,000 and 30,000, the second peak (peak B) at between 30,000 and 200,000, and the third peak (peak C) at between 200,000 and 2,750,000. The ratio among the heights of the third ($H_c$), second ($H_b$) and the first ($H_a$) peaks is about 0.4–1.5/1.0/0.4–1.0. The THF-soluble portion of the resin binder has a molecular weight distribution, MWD (measured as the ratio of the weight average molecular weight, Mw, and the number average molecular weight, Mn; or Mw/Mn) of 10 to 40. The portion of the molecular weight distribution represented by peak A provides the key ingredient contributing to the thermal fixing property of the resin. Whereas, the portion of the molecular weight distribution represented by peak B provides an important transition between peak A and peak C; it also contributes to the thermal fixing property of the resin. The remaining portion of the molecular weight distribution, as represented by peak C, is the key ingredient providing the anti-offsetting characteristic of the resin; it also provides the transition between the THF-insoluble gel portion and the low and medium molecular weight portions (i.e., peaks A and B) of the resin composition.

The preferred resin binder disclosed in the present invention has a glass transition temperature (Tg) between 55° and 75° C. If the Tg is below 55° C., the toner could not provide the requisite storageablity. On the other hand, if the Tg is above 75° C., the toner would show poor thermal fixing property.

The resin binder disclosed in the present invention further contains about 0.5 to 1.5 wt % of polysiloxane (i.e., silicone oil), which is added into the reaction mixture during the polymerization along with reactant monomers to achieve uniform dispersion therein. The polysiloxane can be polydimethyl siloxane, or polyester-modified, amino-modified, or acrylic-modified polysiloxane. When the amount of polysiloxane is less than 0.5%, the resultant toner lacks good humidity resistance, optical density and uniformity. On the other hand, if the amount of polysiloxane exceeds 1.5%, it can adversely affect the particle-forming stability of the resin during polymerization process, as well as the resolution of the copies developed with the resultant toner.

DETAILED DESCRIPTION OF THE PREFERRED EMBODIMENTS

Extensive studies were conducted on toners of various compositions to attain the objects described hereinabove. As a consequence, it has been found that these objects can be accomplished when a styrene-acrylic type copolymer with a THF-insoluble gel content of about 10 to 40% of the resin composition was used as a resin binder in preparing the toner. The THF-soluble portion of the resin has a trimodal molecular weight distribution comprising three major peaks, as measured with gel permeation chromatography (GPC); the first peak (peak A) occurs at a molecular weight of between about 3,000 and 30,000, the second peak (peak B) at between 30,000 and 200,000, and the third peak (peak C) at between 200,000 and 2,750,000. The ratio among the heights of the third ($H_c$), second ($H_b$) and the first ($H_a$) peaks is about 0.4–1.5/1.0/0.4–1.0.

Gel content of the resin is measured by placing about 1 to 2 g of the resin on a 400-mesh stainless steel gauze. The weight of the resin was measured as W1 and the combined weight of the resin and the stainless steel gauze was measured as W2. The stainless steel gauze containing the resin was then placed inside a continuous extraction device and THF was circulated therethrough as solvent for 24 hours. After vacuum dried, the weight of the stainless steel containing the THF-extracted residue was measured as W3. The gel content of the resin was calculated by the following formula:

$$\text{Gel Content (wt \%)} = 1 - \frac{W_2 - W_3}{W_1}$$

Figure 1:
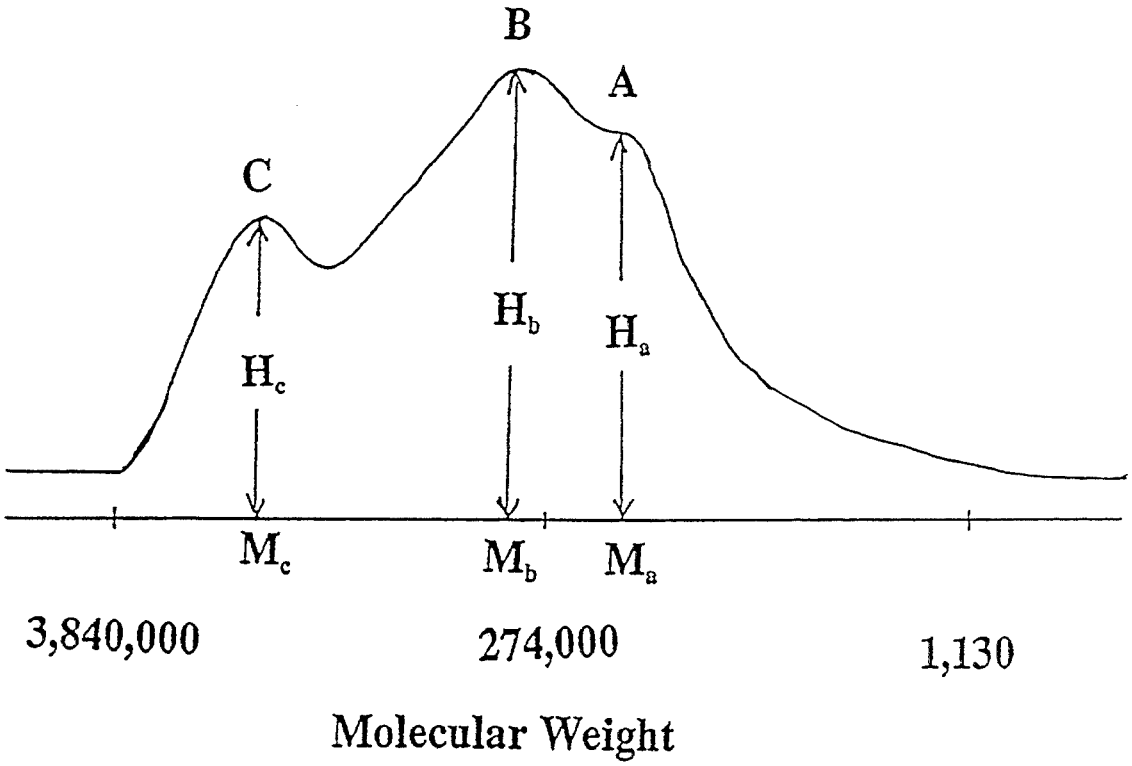
FIG. 1 is a typical gel permeation chromatogram showing the molecular weight distribution of the resin binder of the present invention.

Molecular weight and molecular weight distribution of the resin were measured using gel permeation chromatography (GPC). A typical chromatogram obtained from the resin of the present invention is shown in FIG. 1. The GPC chromatograms were obtained using a Waters Model-590 with five columns connected in series: μ-styragel $10^6$ Å, 500 Å (Waters), and PS-1, PS-20, and PS-400 (Merk, German). The GPC columns were calibrated using polystyrene standards having molecular weights of 2,750,000, 1,400,000, 515,000, 194,000, 87,000, 34,500, 10,200, 5,100, 1,050, and 480, manufactured by Merk.

Figure 2:
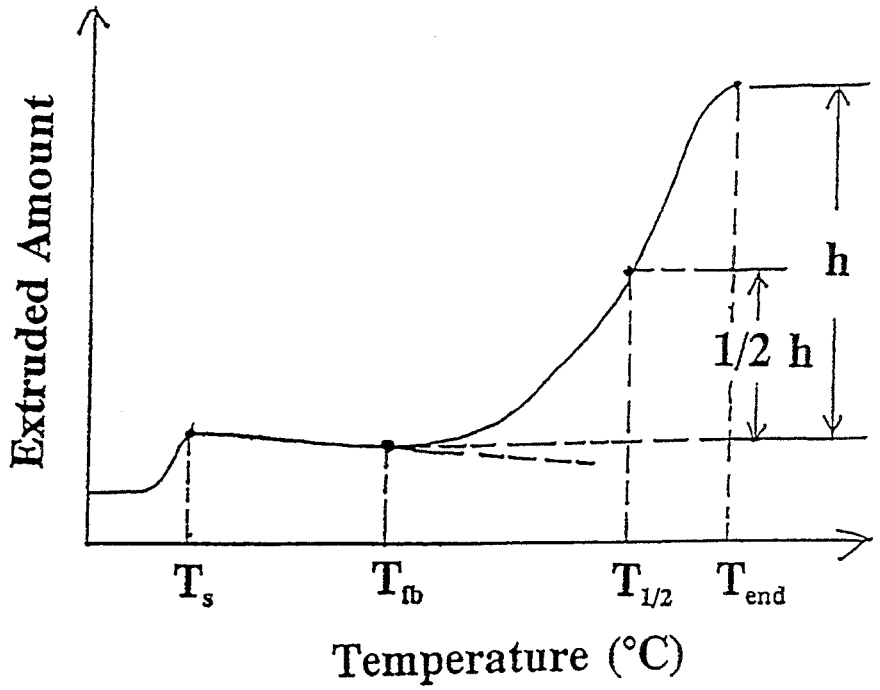
FIG. 2 is a typical melt flow curve measured from the resin binder of the present invention.

Rheological property of the resin was measured using a Shimadzu Flow Tester CFF-500. 1.40 g of the resin was precisely measured and molded into a cylindrical test specimen 15 mm high and 10 mm in diameter. The test specimen was placed under a fixed load of 10 $Kg_f$ and preheated for 10 minutes. Flow tests were started at a temperature of 40° C., then increased at a rate of 5° C. per minute. The melted resin was forced through an aperture 10 mm in length and 1 mm in diameter. A typical melt flow curve of the resin disclosed in the present invention is shown in FIG. 2. The preferred resin should exhibit a softening temperature $T_s$ at about 70°–90° C. It is preferred that the resin to be used in the above mentioned application has a flow-beginning temperature, $T_{fb}$, of between about 120° and 160° C., and a melt-flow end point temperature, $T_{end}$ of 180°–240° C. A preferred resin should have a melt-flow middle point temperature, $T_{\frac{1}{2}}$, which can be obtained from FIG. 2 through intrapolation, of about 130°–220° C.

It was observed that when the softening temperature was less than 70° C., the toner so prepared did not exhibit satisfactory storageabilty. On the other hand, if the resin binder had a soften temperature greater than 90° C., the resultant toner did not provide adequate thermal fixing property. With regarded to $T_{fb}$, it was observed that the toner had poor anti-offsetting characteristic if it was lower than 120° C., but the toner lost its thermal fixing property if $T_{fb}$, was greater than 160° C. Similar observations were made with regard to $T_{\frac{1}{2}}$ and $T_{end}$, except that the two border temperatures were 130° C. and 220° C., and 180° C. and 240° C., respectively.

Figure 3:
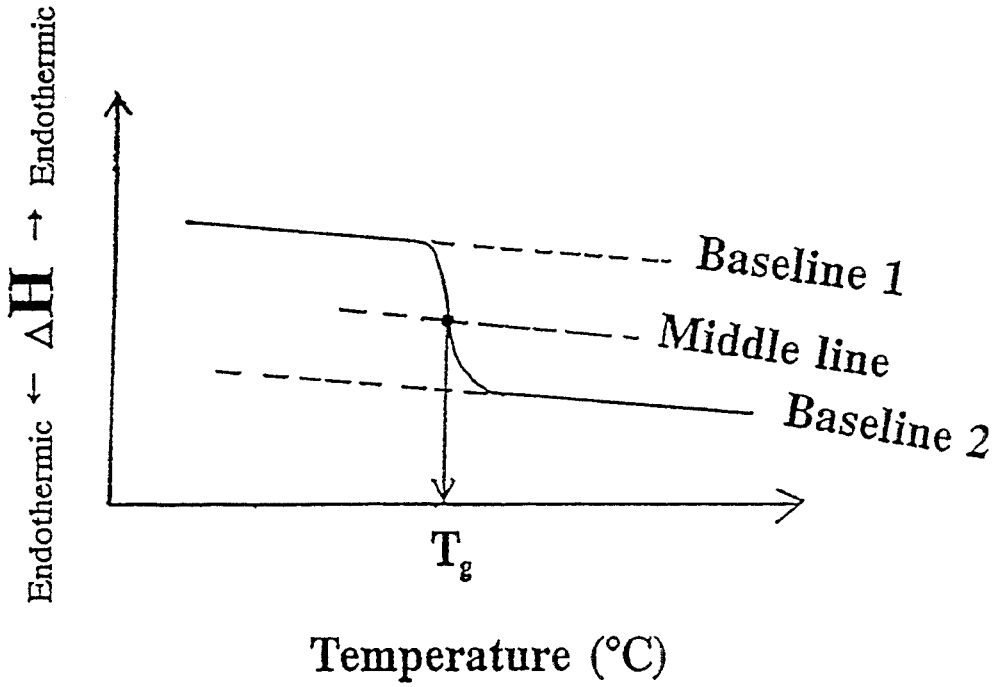
FIG. 3 is a typical differential thermal analysis curve for measuring the glass transition temperature of the resin binder of the present invention.

It is preferred that the resin binder disclosed in the present invention has a glass transition temperature (Tg) between 55° and 75° C. If the Tg is below 55° C., the toner could not provide the requisite storageablity. On the other hand, if the Tg is above 75° C., the toner would show poor thermal fixing property. FIG. 3 shows a typical differential thermal analysis curve for measuring the glass transition temperature of the resin binder of the present invention.

The present invention will now be described more specifically with reference to the following examples. It is to be noted that the following descriptions of examples including preferred embodiments of this invention are presented herein for purpose of illustration and description; it is not intended to be exhaustive or to limit the invention to the precise form disclosed.

EXAMPLE 1

Example 1 describes the preparation of a resin composition according to a preferred embodiment of the present invention, and the test results obtained from a toner composition containing the same. The reactant compositions utilized in this example are shown in Table 1, which describes three different reactant compositions which are introduced into the reaction bath during three different stages of the polymerization reaction: pre-reaction, continuous reactant feeding stage 1, and continuous reactant feeding stage 2. The polymerization reaction was conducted in a reaction bath containing 150 parts of deionized water, 4 parts of calcium phosphate ($Ca_3(PO_4)$), and 1 part of sodium n-dodecylbenzenesulfonate. The solution mixture was stirred, and nitrogen was charged into the reaction bath to purge air.

The pre-reaction reactant composition was added to the reaction bath. Thereafter, the temperature of the reaction bath was raised to 80° C. Then reactant composition of continuous feeding stage 1 was slowly fed using a metering pump. The total feeding time during the continuous reactant feeding stage 1 was about three hours. Finally reactant composition of continuous feeding stage 2 was slowly fed into the reaction bath, also using a metering pump. The total feeding time during the continuous reactant feeding stage 2 was about one hour. The polymerization was allowed to continue for six hours at 80° C. The properties of the resin produced are summarized in Table 2.

The next step involved the preparation of a toner composition. 62 parts of the resin obtained from the above procedure, 38 parts of magnetic powder (Mapico Black B, from Columbia Chemicals), 2 parts of low molecular weight wax (Viscol 660P, from Sanyo, Japan), and 2 parts of a charge control agent (CCA-7 from ICI) were blended, compounded, coarse-pulverized, fine-pulverized, and classified to obtain 5–30 μm particles. The particles were then treated with 0.2 wt % hydrophobic silicon dioxide (R-972, from Degussa, AG) to obtain a toner composition which was then used in a printing test.

The toner prepared hereinabove was tested using a Canon LBP-8II laser printer. The fixing temperature was set at 180° C., and 2,000 copies were printed on a continuous basis. Test results, which include thermal fixing property, anti-offseting characteristics, humidity resistance, print concentration, and homogeneity, are summarized in Table 4. Storageability of the toner was tested by placing the same in a 50° C. oven for 24 hours to observe any aggregation.

EXAMPLE 2 THROUGH 4

Examples 2 through 4 describe preparation of three resin compositions, and the corresponding toner compositions, according to other preferred embodiments of the present invention. The reactant compositions utilized in these examples are shown in Table 3. The procedures in preparing the resin compositions are identical to those described in Example 1, except that the feed compositions are different. The properties of the resins produced in these examples are summarized in Table 2.

The toners prepared in these examples were also tested with a procedure identical to that in Example 1, and the results are summarized in Table 4.

EXAMPLE 5

A toner composition comprising 90 parts of the resin obtained from Example 1, 10 parts of carbon black (Raven 5750, from Columbia Chemicals), 2 parts of low molecular weight wax (Viscol 660P, from Sanyo, Japan), and 2 parts of a charge control agent (CCA-7 from ICI) were blended, compounded, coarse-pulverized, fine-pulverized, and classified to obtain 5–30 μm particles. The particles were then treated with 0.2wt % hydrophobic silicon dioxide (R-972, from Degussa, AG) to obtain a toner composition which was then used in a printing test.

The toner prepared hereinabove was tested with an IBM 4019 laser printer. The fixing temperature was set at 180° C., and 2,000 copies were printed on a continuous basis. Test results, which include thermal fixing property, anti-offseting characteristics, humidity resistance, print concentration, and homogeneity, are summarized in Table 4.

EXAMPLE 6

A toner composition comprising 45 parts of the resin obtained from Example 1, 55 parts of magnetic powder (Mapico Black B, from Columbia Chemicals), 2 parts of low molecular weight wax (Viscol 660P, from Sanyo, Japan), and 2 parts of a charge control agent (CCA-7 from ICI) were blended, compounded, coarse-pulverized, fine-pulverized, and classified to obtain 5–30 μm particles. The particles were then treated with 0.2 wt % hydrophobic silicon dioxide (R-972, from Degussa, AG) to obtain a toner composition which was then used in a copying test.

The toner prepared hereinabove was tested with a Fuji Xerox 2770 copier. The fixing temperature was set at 180° C., and 2,000 copies were printed on a continuous basis. Test results, which include thermal fixing property, anti-offseting characteristics, humidity resistance, print concentration, and homogeneity, are summarized in Table 4.

Comparative Example 1

A commercial styrene-acrylic copolymer, Tradename RESD-128 manufactured by Hercules, was used as the resin binder in preparing a toner composition. The properties of the commercial styrene-acrylic copolymer are shown in Table 2. The toner was prepared and tested using a procedure identical to that in Example 1, and the results are summarized in Table 4.

Comparative Example 2

A styrene-acrylic copolymer was prepared having the following reaction composition:

| component | parts |
|---|---|
| styrene | 78 |
| n-butyl acrylate | 22 |
| azobisisobutyronitrile | 2 |
| Calcium Phosphate | 4 |
| Sodium n-dodecylbenzenesulfonate | 1 |
| Deionized Water | 150 |

The styrene-acrylic copolymer was then used as the resin binder in preparing a toner composition. The properties of the commercial styrene-acrylic copolymer are shown in Table 2. The toner was prepared and tested using a procedure identical to that in Example 1, and the results are summarized in Table 4.

Comparative Examples 3 and 4

The reactants and polymerization procedures for preparing the resin binders of Comparative Examples 3 and 4 were the same as those in Example 1, except that the reactant compositions did not contain polysiloxane, and that the divinyl benzene contents in the pre-reaction mixture were 1.0 and 0.1, respectively. The properties of the styrene-acrylic copolymer are shown in Table 2. Two corresponding toners were prepared and tested using a procedure identical to that in Example 1, and the results are summarized in Table 4.

Comparative Examples 5 through 8

The reactants and polymerization procedures for preparing the resin binders of Comparative Examples 5 through 8 were the same as those in Example 1 through 4, respectively, except that the reactant compositions did not contain polysiloxane. The properties of the styrene-acrylic copolymers are shown in Table 2. Four corresponding toners were prepared and tested using a procedure identical to that in Example 1, and the results are summarized in Table 4.

Comparative Example 9

A liquid mixture containing 1 part of polydimethylsiloxane, diluted with 3 parts of isopropyl alcohol was prepared. The liquid mixture was then added into a high-speed blender containing 38 parts of magnetic powder (Mapico Black B, from Columbia Chemicals). Thereafter, the isopropyl alcohol was removed by evaporation to obtain polydimethylsiloxane surface treated magnetic powder.

62 parts of the resin binder from Comparable Example 5, 38 parts of the polydimethylsiloxane surface treated magnetic powder from above, 2 parts of low molecular weight wax (Viscol 660P, from Sanyo, Japan), and 2 parts of a charge control agent (CCA-7 from ICI) were blended, compounded, coarse-pulverized, fine-pulverized, and classified to obtain 5–30 μm particles. The particles were then treated with 0.2 wt % hydrophobic silicon dioxide (R-972, from Degussa, AG) to obtain a toner composition which was then used in a printing test, with a procedure identical to that described in Example 1. The test results are summarized in Table 4.

Comparative Example 10

A liquid mixture containing 0.6 parts of amino-modified polysiloxane (KP-359 manufactured by Shin-E of Japan) diluted with 3 parts of isopropyl alcohol was prepared. The liquid mixture was then added into a high-speed blender containing 38 parts of magnetic powder (Mapico Black B, from Columbia Chemicals). Thereafter, the isopropyl alcohol was removed by evaporation to obtain magnetic powder whose surface was treated with amino-modified polysiloxane.

62 parts of the resin binder from Comparative Example 8, 38 parts of the surface treated magnetic powder from above, 2 parts of low molecular weight was (Viscol 660P, from Sanyo, Japan), and 2 parts of a charge control agent (CCA-7 from ICI) were blended, compounded, coarse-pulverized, fine-pulverized, and classified to obtain 5–30 μm particles. The particles were then treated with 0.2 wt % hydrophobic silicon dioxide (R-972, from Degussa, AG) to obtain a toner composition which was then used in a printing test, with a procedure identical to that described in Example 1. The test results are summarized in Table 4.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

TABLE 1

| Component | Formulated Ratio (parts by weight) Pre-Reaction | Continuous Feeding Stage 1 | Continuous Feeding Stage 2 |
|---|---|---|---|
| monomer[1] | 60 | 30 | 10 |
| azobisisobutyronitrile | 0.6 | 0.3 | 0.1 |
| divinylbenzene | 0.3 | — | — |
| n-dodecane-thiol | 0.3 | 0.6 | 0.75 |
| polydimethylsiloxane | 1.0 | — | — |

[1](styrene)/(n-butyl methacrylate) = 63/37.

TABLE 2

| Resin Type | Gel Content | Molecular Weight × $10^{-3}$ $M_c$ | $M_b$ | $M_a$ | $H_c/H_b/H_a$ | MWD | Silicone Oil Method of Use | Amount | Characteristic Temperatures (°C.) Tg | $T_s$ | $T_{fb}$ | $T_{\frac{1}{2}}$ | $T_{end}$ |
|---|---|---|---|---|---|---|---|---|---|---|---|---|---|
| Example 1 | 8% | 1030 | 46 | 16 | 0.75/1/0.85 | 15 | during reaction | 1.0% | 58 | 74 | 126 | 160 | 169 |
| Example 2 | 18% | 490 | 46 | 16 | 1.13/1/0.68 | 17 | during reaction | 0.8% | 63 | 79 | 133 | 171 | 182 |
| Example 3 | 26% | 2070 | 56 | 15 | 1.07/1/0.78 | 22 | during reaction | 1.2% | 63 | 82 | 147 | 194 | 217 |
| Example 4 | 33% | 1540 | 46 | 16 | 1.30/1/0.83 | 33 | during reaction | 0.6% | 58 | 76 | 150 | 214 | 234 |
| Comp. Ex. 1 | 0 | — | 34 | — | 0/1/0 | 2 | — | — | 60 | 75 | 107 | 132 | 138 |
| Comp. Ex. 2 | 0 | — | 190 | — | 0/1/0 | 3 | — | — | 58 | 77 | 117 | 150 | 158 |
| Comp. Ex. 3 | 55% | 2750 | 56 | 16 | 1.66/1/0.64 | 43 | — | — | 64 | 84 | 170 | 244 | 270 |
| Comp. Ex. 4 | 5% | 430 | 46 | 16 | 0.37/1/0.76 | 12 | — | — | 62 | 82 | 122 | 153 | 162 |
| Comp. Ex. 5 | 8% | 1030 | 46 | 16 | 0.75/1/0.85 | 15 | — | — | 58 | 74 | 126 | 160 | 169 |
| Comp. Ex. 6 | 18% | 490 | 46 | 16 | 1.13/1/0.68 | 17 | — | — | 63 | 79 | 133 | 171 | 182 |
| Comp. Ex. 7 | 26% | 2070 | 56 | 15 | 1.07/1/0.78 | 22 | — | — | 63 | 82 | 147 | 194 | 217 |
| Comp. Ex. 8 | 33% | 1540 | 46 | 15 | 1.30/1/0.83 | 33 | — | — | 58 | 76 | 150 | 214 | 234 |

TABLE 3

| Reactant Feeding Stage | Component | Formulated Ratio (parts by weight) Example 2 | Example 3 | Example 4 |
|---|---|---|---|---|
| Pre-Reaction | monomer | 60(1) | 60(2) | 60(3) |
| | azobisisobutyronitrile | 0.6 | 0.6 | 0.6 |
| | divinylbenzene | — | — | 0.3 |
| | 1,4-butanediol dimethacrylate | — | 0.6 | — |
| | ethylene glycol dimethacrylate | 0.58 | — | — |
| | n-dodecane-thiol | 0.3 | 0.3 | 0.3 |
| | polydimethylsiloxane | 0.8(4) | 1.2(5) | 0.6(6) |
| Continuous Feeding Stage 1 | monomer | 30 | 30 | 30 |
| | azobisisobutyronitrile | 0.3 | 0.3 | 0.3 |
| | n-dodecane-thiol | 0.8 | 0.8 | 0.6 |
| Continuous Feeding Stage 2 | monomer | 10 | 10 | 10 |
| | azobisisobutyronitrile | 0.1 | 0.3 | 0.1 |
| | trimethylolpropane trimethacrylate | — | — | 0.06 |
| | n-dodecane-thiol | — | — | 0.75 |

(1)(styrene)/(n-butyl acrylate) = 80/20
(2)(styrene)/(n-butyl methacrylate) = 68/32
(3)(styrene)/(n-butyl methacrylate) = 63/37
(4)polyester-modified polysiloxane
(5)acrylic-modified polysiloxane
(6)amino-modified polysiloxane

TABLE 4

| Toner | Thermal Fixing Property | Anti-Offsetting Characteristic | optical density normal humidity | high humidity | change | uniformity initial printing | repeated printing | Storageability |
|---|---|---|---|---|---|---|---|---|
| Example 1 | good | good | good (1.44) | good (1.34) | −7% | good | good | good |
| Example 2 | good | good | good (1.43) | good (1.31) | −8% | good | good | good |
| Example 3 | good | very good | good (1.44) | good (1.35) | −6% | good | good | good |
| Example 4 | good | very good | good (1.42) | good (1.30) | −8% | good | good | good |
| Example 5 | good | good | good (1.43) | good (1.34) | −6% | good | good | good |
| Example 6 | good | good | good (1.43) | good (1.33) | −6% | good | good | good |
| Comp. Ex. 1 | good | very poor | good (1.38) | poor (0.90) | −35% | good | fair | good |
| Comp. Ex. 2 | good | poor | good (1.38) | poor (0.92) | −33% | good | fair | good |
| Comp. Ex. 3 | very poor | good | good (1.42) | poor (0.97) | −32% | good | fair | good |
| Comp. Ex. 4 | good | fair | good (1.43) | poor (0.96) | −33% | good | fair | good |
| Comp. Ex. 5 | good | good | good (1.43) | poor (0.95) | −33% | good | fair to good | good |
| Comp. Ex. 6 | good | good | good (1.43) | poor (0.96) | −33% | good | fair to good | good |

TABLE 4-continued

| Toner | Thermal Fixing Property | Anti-Offsetting Characteristic | optical density | | | uniformity | | Storageability |
|---|---|---|---|---|---|---|---|---|
| | | | normal humidity | high humidity | change | initial printing | repeated printing | |
| Comp. Ex. 7 | good | good | good (1.43) | poor (0.95) | −33% | good | fair to good | good |
| Comp. Ex. 8 | good | good | good (1.42) | poor (0.96) | −32% | good | fair to good | good |
| Comp. Ex. 9 | good | good | good (1.42) | fair (1.16) | −18% | good | fair to good | good |
| Comp. Ex. 10 | good | good | good (1.42) | fair (1.15) | −19% | good | fair to good | good |

What is claimed is:

1. A toner composition for use in electrophotographic processes comprising a colorant and a resin binder, said resin binder comprising a styrene-acrylic copolymer; wherein said styrene-acrylic copolymer having about 10 to 40% of THF-insoluble portion and about 60 to 90% of THF-soluble portion;

said THF-soluble portion having a trimodal molecular weight distribution characterized by first, second and third main peaks as measured by gel permeation chromatography, each having a respective height;

said first main peak representing a molecular weight between 3,000 and 30,000, said second main peak representing a molecular weight between 30,000 and 200,000, and said third main peak representing a molecular weight between 200,000 and 2,750,000; and said first, second, and third main peaks having a ratio of 0.4–1.0/1/0.4–1.5, measured based on their respective peak heights.

2. The toner composition of claim 1 wherein said resin binder being prepared from a polymerization reaction process which includes the step of adding 0.5 to 1.5% polysiloxane during said polymerization reaction in the production of said styrene-acrylic copolymer.

3. The toner composition of claim 2 wherein said polysiloxane is selected from the group consisting of polydimethylsiloxane, polyester-modified polysiloxane, amino-modified polysiloxane, and acrylic-modified polysiloxane.

4. The toner composition of claim 1 wherein said styrene-acrylic copolymer having a softening temperature between 70° and 90° C., a melt flow beginning temperature between 120° and 160° C., a melt flow middle point temperature between 130° and 220° C., and a melt flow end point temperature between 180° and 240° C.

5. The toner composition of claim 1 wherein said styrene-acrylic copolymer having a glass transition temperature between 55° and 75° C.

6. The toner composition of claim 1 wherein said third main peak is about 28–42% of the sum of said first, second, and third main peaks, measured based on their respective peak heights.

7. A toner binder resin composition for use in electrophotographic processes comprising:

a styrene-acrylic copolymer having about 10 to 40% of THF-insoluble portion and about 60 to 90% of THF-soluble portion;

said THF-soluble portion having a trimodal molecular weight distribution characterized by first, second and third main peaks as measured by gel permeation chromatography, each having a respective height;

said first main peak representing a molecular weight between 3,000 and 30,000, said second main peak representing a molecular weight between 30,000 and 200,000, and said third main peak representing a molecular weight between 200,000 and 2,750,000; and said first, second, and third main peaks having a ratio of 0.4–1.0/1/0.4–1.5, measured based on their respective peak heights.

8. The toner binder resin of claim 7 wherein said resin binder being prepared from a polymerization reaction process which includes the step of adding 0.5 to 1.5% of polysiloxane during said polymerization reaction in the production of said styrene-acrylic copolymer.

9. The toner binder resin of claim 7 wherein said third main peak is about 28–42% of the sum of said first, second, and third main peaks, measured based on their respective peak heights.

10. The toner binder resin of claim 7 wherein said styrene-acrylic copolymer having a softening temperature between 70° and 90° C., a melt flow beginning temperature between 120° and 160° C., a melt flow middle point temperature between 130° and 220° C., and a melt flow end point temperature between 180° and 240° C.

11. The toner binder resin of claim 7 wherein said styrene-acrylic copolymer having a glass transition temperature between 55° and 75° C.

* * * * *